US006132241A

United States Patent [19]

Hwang

[11] Patent Number: 6,132,241

[45] Date of Patent: Oct. 17, 2000

[54] ELECTRICAL CONNECTOR ASSEMBLY HAVING PROTECTION PARTITION

[75] Inventor: Jeng-Yih Hwang, Irvine, Calif.

[73] Assignee: Hon Hai Precision Ind. Co., Ltd., Taipei Hsien, Taiwan

[21] Appl. No.: 09/351,411

[22] Filed: Jul. 9, 1999

[51] Int. Cl.[7] ..... H01R 13/58

[52] U.S. Cl. ..... 439/459; 439/405

[58] Field of Search ..... 439/459, 456, 439/492, 499, 405, 404

[56] References Cited

U.S. PATENT DOCUMENTS

| | | | |
|---|---|---|---|
| 4,648,677 | 3/1987 | Lang | 439/459 |
| 4,960,390 | 10/1990 | Davis et al. | 439/459 |
| 5,338,221 | 8/1994 | Bowen et al. | 439/405 |

*Primary Examiner*—Gary F. Paumen
*Attorney, Agent, or Firm*—Wei Te Chung

[57] ABSTRACT

An electrical connector assembly, comprises a first connector assembled to a printed circuit board and a second connector releasably mated thereto. The second connector mated to the first connector includes a second housing defining a cavity for receiving an island portion of the first connector. The second housing forms a pair of mounting wedges at ends thereof and retaining recesses adjacent to the mounting wedges. A termination cover assembled to the second connector includes a pair of mounting lugs engaged to the mounting wedges. A pair of passages defined in the cover adjacent to the mounting lugs. A strain relief assembled to the termination cover forms inner latches engaged to the retaining recess and outer latches pivotally hinged to the base bar. The outer latches are releasably received in the retaining recess of the first connector when the second connector is mated to the first connector.

13 Claims, 3 Drawing Sheets

ELECTRICAL CONNECTOR ASSEMBLY HAVING PROTECTION PARTITION

FIELD OF THE INVENTION

The present invention relates to an electrical connector assembly, and more particularly to an assembly having a first connector and a second connector mated to the first connector. Interconnection between the first and second connectors is affirmed by a strain relief having inner latches which are well protected from being accidentally released during mating of the first and second connectors.

DESCRIPTION OF PRIOR ART

Conventionally, an IDC connector assembled to an end of a cable is directly plugged to a complimentary connector (normally a header connector) mounted on a printed circuit board. The termination between insulation displacement portions and conductors of the cable is facilitated by a termination cover assembled to the housing of the IDC connector. In order to prevent the termination from being accidentally separated during withdraw of the IDC connector from the header, one of the approach is to provide a strain relief assembled to the termination cover thereby preventing the termination from being damaged during removal of the IDC connector.

Another approach addressed to this problem is to provide a pull-tab assembled to the termination cover. This may also prevent the termination from being separated during removal of the IDC connector.

As ultra SCSI connectors have been made in the form of IDC connector, mating/withdrawing between two ultra SCSI connectors become a problem because the normal force existed between two mated connector is too large to overcome by fingers. In order to easily remove the female ultra SCSI connector, usually assembled to an end of a cable, and a header SCSI connector, usually mounted in a printed circuit board, a strain relief is introduced. The strain relief includes first latches engaged to the female SCSI connector and second latches releasably engaged to the header connector. However, the first latches are easily and accidentally released by portions of the header SCSI connector since the first latches are vulnerable to be tempered.

SUMMARY OF THE INVENTION

An objective of this invention is to provide an electrical connector assembly having a first connector and a second connector mated to the first connector. Interconnection between the first and second connectors is affirmed by a strain relief having inner latches which are well protected from being accidentally released during mating of the first and second connectors.

An electrical connector assembly, comprises a first connector assembled to a printed circuit board and a second connector releasably mated thereto. The second connector mated to the first connector includes a second housing defining a cavity for receiving an island portion of the first connector. The second housing forms a pair of mounting wedges at ends thereof and retaining recesses adjacent to the mounting wedges. A termination cover assembled to the second connector includes a pair of mounting lugs engaged to the mounting wedges. A pair of passages defined in the cover adjacent to the mounting lugs. A strain relief assembled to the termination cover forms inner latches engaged to the retaining recess and outer latches pivotally hinged to the base bar. The outer latches are releasably engaged to the hookers of first connector when the second connector is mated to the first connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
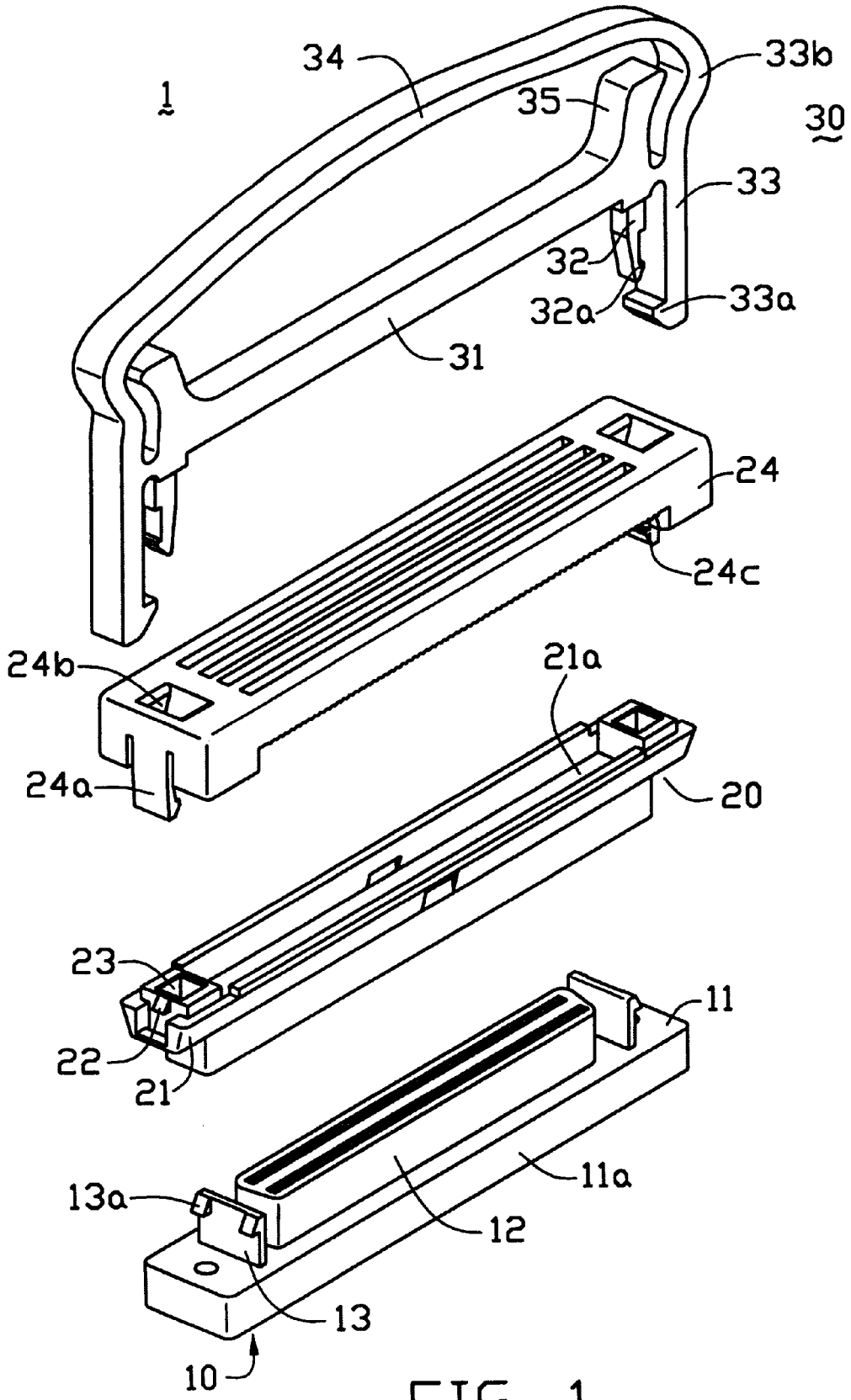
FIG. 1 is a perspective view of an electrical connector assembly in accordance with the present invention.
Figure 2:
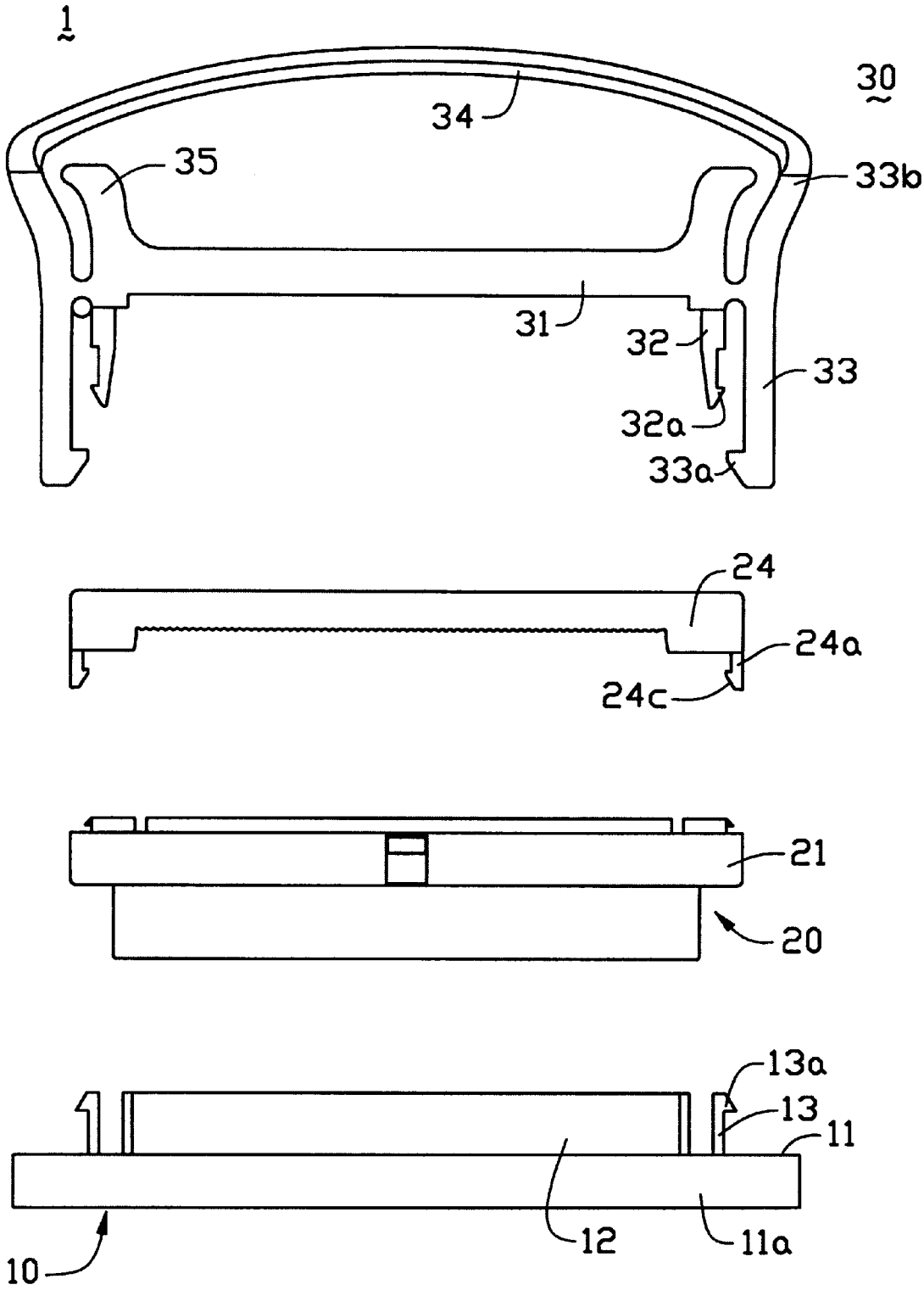
FIG. 2 is an assembled view of FIG. 1.
Figure 3:
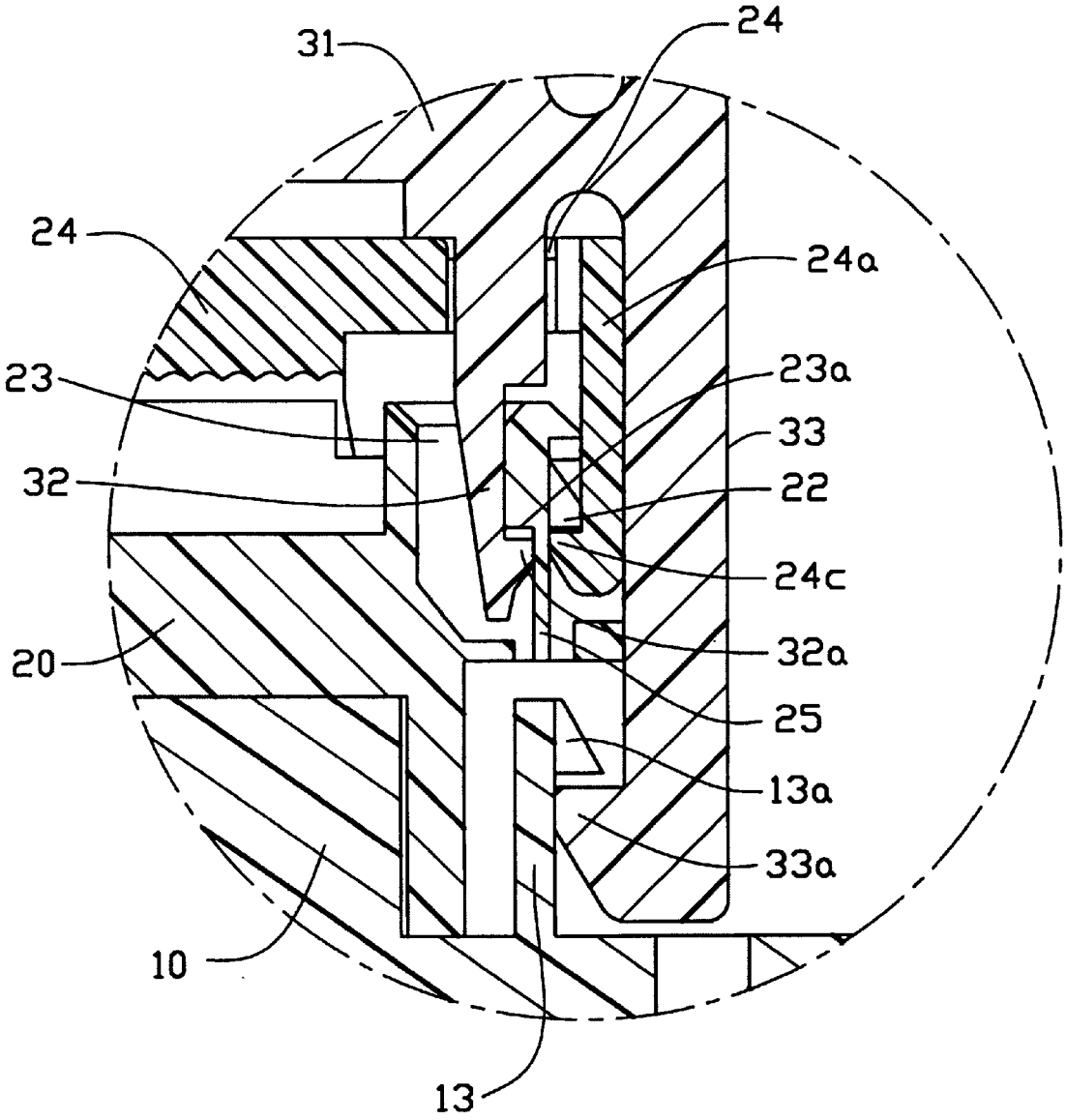
FIG. 3 is a cross sectional view showing relationship between inner and outer latches and the mounting wedges and the retaining recess.

Referring to FIGS. 1, 2, and 3, an electrical connector assembly 1 in accordance with the present invention comprises a first connector 10 and a second connector 20 mated to the first connector 10. In the preferred embodiment, the first connector 10 is a female ultra SCSI connector and the second connector 20 is an IDC SCSI connector. The first connector 10 can be assembled to a printed circuit board (not shown).

The first connector 10 includes a first housing 11 having a base plate 11*a* forming an island portion 12 thereof. A pair of hooks 13 is formed on the base plate 1*a*. Each hook 13 includes a projection 13*a* extending outward. The second connector 20 includes a second housing 21 defining a cavity (not labeled) for receiving the island portion 12 of the first connector 10. The second housing 21 has a termination face 21*a* opposite to the cavity. A pair of mounting wedges 22 is formed on opposite ends thereof. The second housing 21 further defines a pair of retaining recesses 23 adjacent to the mounting wedge 22. An engaging block 23*a* is formed within the retaining recess 23. A termination cover 24 is assembled to the termination face 21*a* of the second connector 20 for performing electrical connections between a FFC cable and insulation displacement sections (not shown) of the second connector 20. The termination cover 24 includes a pair of mounting lugs 24*a* having thereon an inward projection 21*c* engaged to the mounting wedges 22. A pair of passages 24*b* is defined in the cover 24 adjacent to the mounting lugs 24*a*.

A strain relief 30 is assembled to the second connector 20. The strain relief 30 includes a base bar 31 forming a pair of inner latches 32 and a pair of outer latches 33 pivotally hinged to said base bar 31. The inner latches 32 extend through the passage 24*b* and into the retaining recess 23. The inner latch 32 defines an outward projection 32*a* and the outer latch 33 defines an inward projection 33*a* facing toward each other. The projection 32*a* of the latch 32 engages to the engaging block 23*a* when the strain relief 30 is assembled to the second connector 20. Because the latches 32 are inserted into the retaining recesses 23, engagement between the projections 32*a* and the block 23*a* can be reliably ensured. Rear ends 33*b* of the outer latch 33 are further bridged by a handle 34. When the handle 34 is pulled upward, the inward projections 33*a* of the outer latches 33 are pivoted away from each other. The base bar 31 further includes a pair of horns 35 for limiting inward movement of the rear ends 33*b* when the handle 34 is pulled upward. Once the handle 34 is resumed to its original position, engagement between the projections 33*a* and the hookers 13 is ensured. In addition, clipping force of the outer latches 33 is further enhanced by the handle 34.

As clearly shown in FIG. 3, the inner latch 31 is well protected within the retaining recess 23 such that engagement between the projection 31 and the block 23*a* can never be tempered or accidentally released by the hook 13 when the second connector 20 is assembled to the first connector 10.

In assembly, the termination cover 24 is firstly assembled to the second connector 20 to facilitate electrical termination between the FFC cable and the second connector 20. The strain relief 30 is then assembled to the second connector 20 by the engagement between the inner latches 32 and the retaining recesses 23. Then the second connector 20 can be assembled to the first connector 10. Aside the mating between the cavity and the island portion 12, the mating is further enhanced by the engagement between the outer latches 33 and the hookers 13.

When separation between the second connector 20 and the first connector 10 is required, the handle 34 is pulled upward whereby the rear ends 33*b* are moved toward each other thereby rendering the projections 33*a* of the outer latches 33 open widely to release the projections 33*a* from the hookers 13. In addition, the upward pulling force may easily separate the second connector 20 from the first connector 10.

It is noted that the mounting lug 24*a* of the cover 24 and the inner latch 32 of the strain relief 30 are positioned by two sides of the end wall 25 (FIG. 3) of the second connector 20, and are respectively latchably engaged with the corresponding mounting wedge 22 and the engaging block 23*a* on two sides of the end wall 25, so as to respectively obtain reliable locking with regard to the second connector 20 without mutual influence. By the way, the mounting lug 24*a* of the cover 24 further is sandwiched between the outer latch 33 of the strain relief 30 and the end wall 25 of the second connector 20, thus assuring engagement between the terminal cover 24 and the second connector 20. It is also noted that the hook 13 of the first connector 10 is generally aligned with and under the end wall 25 of the second connector 20 for engagement with the projection 33*a* of the outer latch 33 which extends downward a substantial distance below the end wall 25 of the second connector 20, thus keeping a compact size of the whole connector assembly in the lengthwise direction.

Although the present invention has been described with reference to the preferred embodiment, it is apparent to those skilled in the art that a variety of modifications and changes may be made without departing from the scope of the present invention which is intended to be defined by the appended claims.

I claim:

1. An electrical connector assembly, comprising:

a first connector assembled to a printed circuit board, said first connector including a first housing having a base plate forming an island portion thereof, at least a hook formed on said base plate;

a second connector mated to said first connector, said second connector including a second housing defining a cavity for receiving said island portion of said first connector and a termination face opposite to said cavity, a pair of mounting wedges formed on opposite ends thereof, said second housing further defining a retaining recess adjacent to each said mounting wedge, a termination cover assembled to said termination face of said second connector, said cover including a pair of mounting lugs engaged to said mounting wedges, a pair of passages defined in said cover adjacent to said mounting lugs; and a strain relief assembled to said termination cover, said strain relief forming inner latches engaged to said retaining recesses and outer latches pivotally hinged to a base bar, said outer latches being releasably engaged to said hooks of said first connector when said second connector is mated to said first connector.

2. The electrical connector assembly as recited in claim 1, wherein said retaining recess further includes a block on an inner wall thereof for engaging a projection formed on a tip of said inner latch.

3. The electrical connector assembly as recited in claim 1, wherein said passage of said cover is aligned with said retaining recess of said second housing.

4. The electrical connector assembly as recited in claim 1, wherein said base bar further includes a pair of horns on ends thereof for limiting pivotal movement of said outer lathes.

5. The electrical connector assembly as recited in claim 1, wherein said inner and outer latches are faced to each other.

6. The electrical connector assembly as recited in claim 1, wherein rear ends of said outer latches are bridged by a handle.

7. An electrical connector comprising:

an insulative housing defining an end wall at either end thereof;

a mounting wedge and an engaging block formed on two sides of each end wall;

a terminal cover attachably positioned atop the housing and including a mounting lug latchably engaged with each corresponding mounting wedge; and a strain relief attachably positioned atop the terminal cover and including an inner latch with a projection thereon to latchably engage with the corresponding engaging block; whereby said end wall is sandwiched between the mounting lug of the terminal cover and the inner latch of the strain relief.

8. The connector as recited in claim 7, wherein said mounting lug of the terminal cover is positioned outside the end wall of the housing while the inner latch of the strain relief is positioned inside the end wall of the housing.

9. The connector as recited in claim 7, wherein said strain relief further includes an outer latch positioned beside the mounting lug of the terminal cover, and cooperates with the end wall of the housing to sandwich the mounting lug of the terminal cover therebetween.

10. The connector as recited in claim 9, wherein the mounting lug of the terminal cover defines a first inward projection and the outer latch of the strain relief defines a second projection, and both said first and second inward projections extend toward the end wall.

11. The connector as recited in claim 7, wherein the terminal cover defines a passage adjacent and inside the mounting lug, and the inner latch of the strain relief extends therethrough.

12. The connector as recited in claim 11, wherein the housing defines a retaining recess generally aligned with the passage, and the inner latch of the strain relief extends therethrough.

13. An electrical connector assembly comprising:

a first connector adapted to be mounted to a printed circuit board, said first connector defining a first housing with a hook formed at either end thereof;

a second connector mated with and positioned on said first connector, said second connector including a second housing with a mounting wedge and an engaging block at either end thereof;

a terminal cover positioned on the second housing and including a mounting lug extending downward at either end to latchably engage with the corresponding mounting wedge of the second housing; and a strain relief positioned on the terminal cover and including an inner latch and an outer latch at either end thereof, said inner latch being latchably engaged with the corresponding engaging block of the second housing; wherein the hook of the first connector is generally positioned under the inner latch of the strain relief and the mounting lug of the terminal cover, and said outer latch of the strain relief extends downward beyond the inner latch a distance to latchably engage with the hook thereunder.

* * * * *